US005425160A

United States Patent [19]

Krapf

[11] Patent Number: 5,425,160

[45] Date of Patent: Jun. 20, 1995

[54] MAGNETIC PAPER CLAMP AND METHOD OF PRODUCING SAME

[76] Inventor: Wallace A. Krapf, O'Neill Rd., Macedon, N.Y. 14502

[21] Appl. No.: 219,711

[22] Filed: Mar. 29, 1994

[51] Int. Cl.[6] ..... A44B 21/00

[52] U.S. Cl. ..... 24/67 R; 24/303; 24/114.6

[58] Field of Search ..... 24/67 R, 67.3, 67.9, 24/530, 303, 49 M, 90 HA, 447

[56] References Cited

U.S. PATENT DOCUMENTS

| | | | |
|---|---|---|---|
| 2,448,611 | 9/1948 | Martin | 24/303 |
| 3,350,045 | 10/1967 | Mayers | 248/205 |
| 3,462,803 | 8/1969 | Horton | 24/90 HA |
| 4,255,837 | 3/1981 | Holtz | 24/67 R |
| 4,258,493 | 3/1981 | Kettlestrings et al. . | |
| 4,390,489 | 6/1983 | Segal | 264/126 |
| 4,588,209 | 5/1986 | Zebrowski et al. | 24/303 |
| 4,710,414 | 12/1987 | Northrup et al. | 428/43 |

*Primary Examiner*—Victor N. Sakran
*Attorney, Agent, or Firm*—Shlesinger Fitzsimmons Shlesinger

[57] ABSTRACT

The clamp comprises a strip of heat-settable plastic which has two spaced, parallel strip magnets secured on one surface thereof, and which is bent into generally U-shaped configuration, for example by directing a heat Knife onto the plastic strip medially of the space between said magnets, while folding opposite ends of the strip toward each other until the two magnets are placed in registering engagement with each other. After the plastic strip has been folded it is cooled to heat set the radiused fold, which thereby helps to retain the clamp closed and the magnets in engagement with each other.

10 Claims, 1 Drawing Sheet

MAGNETIC PAPER CLAMP AND METHOD OF PRODUCING SAME

BACKGROUND OF THE INVENTION

This invention relates to an improved magnetic clamp for releasably securing together a plurality of paper documents and the like, and a method of making such clamp. More particularly, this invention relates to an improved clamp of the type described which utilizes a pair of strip magnets that are hinged together by a U-shaped plastic strip which normally assumes a closed position in which the two magnets engage each other, or releasably clamp therebetween a plurality of sheets of paper and the like.

It has long been customary for housewives to utilize small magnets for releasably attaching notes, papers, photographs, and the like, to ferrous metal surfaces, such as for example the metal door of a refrigerator or the lie. By interposing one or more sheets of paper between the refrigerator door and the associated magnet, the magnet functions to retain the documents releasably on the door where they can be readily observed. Such use of the magnets, while providing inexpensive and simple means for displaying paper documents, nevertheless is satisfactory only for retaining one or two rather light documents against the door of a refrigerator. If too many documents are mounted beneath the magnet, the magnet not infrequently is dislodged from the door when the latter is closed, thus dislodging also the papers or documents previously secured to the door.

In the business world, office help frequently employ metal clamps for securing together a plurality of paper documents; and the clamps in turn may be suspended from a wall projection or the like. Metal clamps of the type described are rather expensive, and because of their configuration are not designed to be mounted on the plane surface of a wall or the like.

Still another type of known paper clamp has comprised two, separate magnetic strips, one of which was disposed to be adhesively secured at one side thereof to a wall or the like. Documents were then positioned over the strip which was adhered to the wall, and a second magnetic strip was then positioned over the documents and in registry with the first magnetic strip. The magnetic field extending between the registering strips then caused the documents to be gripped releasably and securely between the two magnetic strips. The disadvantage of this construction, of course, is that one of the magnetic strips can be lost or misplaced. To overcome the foregoing problem efforts have been made to couple or hinge the two magnetic strips together with a strip of transparent celluloid-type material. However, this design resulted in a paper clamp in which the material that hinged or coupled the magnetic strips together tended normally to assume a planar rather than a folded position, and thus tended to urge the magnetic strips away from each other, thereby weakening the gripping power of the two magnetic strips.

A problem common to each of the two above-noted types of magnetic paper clamps is attributable to the fact that each of the two magnetic strips of a respective clamp is made from magnetized particles arranged to extend longitudinally of the strip in parallel rows, and with the particles of one row being of one polarity (for example, north) and the adjacent row being of the opposite polarity (for example, south). For maximum clamp gripping force, it is therefore essential that the two confronting faces of the magnetic strips be in exact registry with each other when the clamp is closed, because if the two faces are laterally offset from each other, there is a corresponding reduction in flux between the strips. No such exact registry of the confronting faces of the magnetic strips was assured by prior art clamps of the type described above.

Accordingly, it is an object of this invention to provide an improved magnetic paper clamp of the type formed from a generally rigid, plastic strip which is folded into U-shaped configuration about a radiused fold located intermediate the side edges of the strip, so that a pair of strip magnetics, which are secured to the inside, confronting surfaces of the folded plastic strip, normally are maintained in registering, confronting engagement with each other.

Another object of this invention is to provide an B improved, generally U-shaped magnetic paper clamp of the type described which has on one outside surface thereof means for mounting the clamp on the surface of a wall or adjustably on a rack.

It is an object also of this invention to provide an improved method of producing a magnetic paper clamp by heat forming the two, parallel legs of a generally U-shaped plastic support member about a radiused fold line, so that the two magnetic strips supported on the legs of the folded plastic strip normally will be maintained in registering, confronting engagement with each other.

Other objects of the invention will be apparent hereinafter from the specification and from the recital of the appended claims, particularly when read in conjunction with the accompanying drawing.

SUMMARY OF THE INVENTION

The clamp is made from a strip of heat-settable plastic having two strip magnets secured in spaced, parallel relation to each other on one surface of the plastic strip. The plastic strip is heated and bent into generally U-shaped configuration, for example by directing a heat knife onto said one surface of said plastic strip medially of the space between said magnets, while folding opposite ends of the strip toward each other until the two magnets are placed in registering engagement with each other. After the plastic strip has been folded, it is cooled so as to heat set the radiused fold, which thereby helps to retain said magnets in engagement with each other, and the clamp in its normally closed position.

One of the two, spaced, parallel leg sections of the U-shaped plastic strip may be longer than the other, and may extend beyond its associated strip magnet to form a display surface on the clamp. Also, the plastic strip may have a matte finish on its outside surface to enable information to be written thereon and wiped off by marking pens or the like.

THE DRAWING

DETAILED DESCRIPTION OF THE PREFERRED EMBODIMENTS

Figure 1:
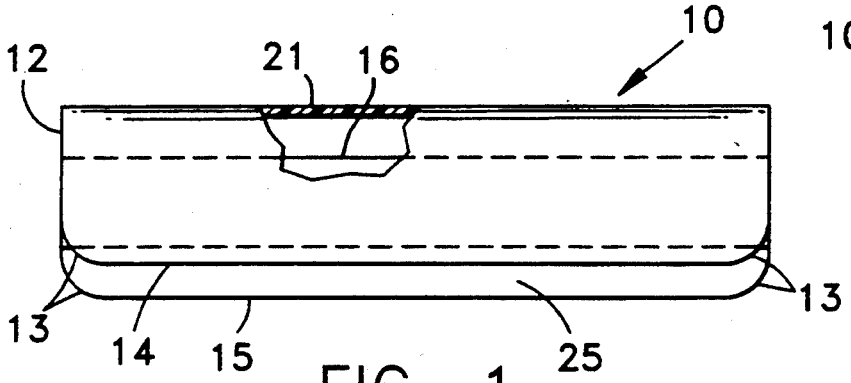
FIG. 1 is a front elevational view of an improved magnetic paper clap made according to one embodiment of this invention, a portion of the clamp being broken away and shown in section for purposes of illustration.
Figure 2:
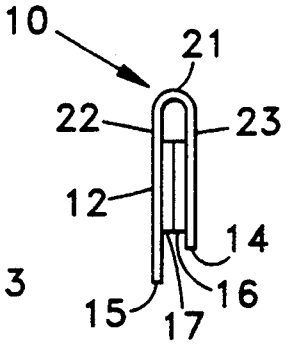
FIG. 2 is an end view of this clamp, as seen when looking at the left end of the clamp as shown in FIG. 1.
Figure 3:
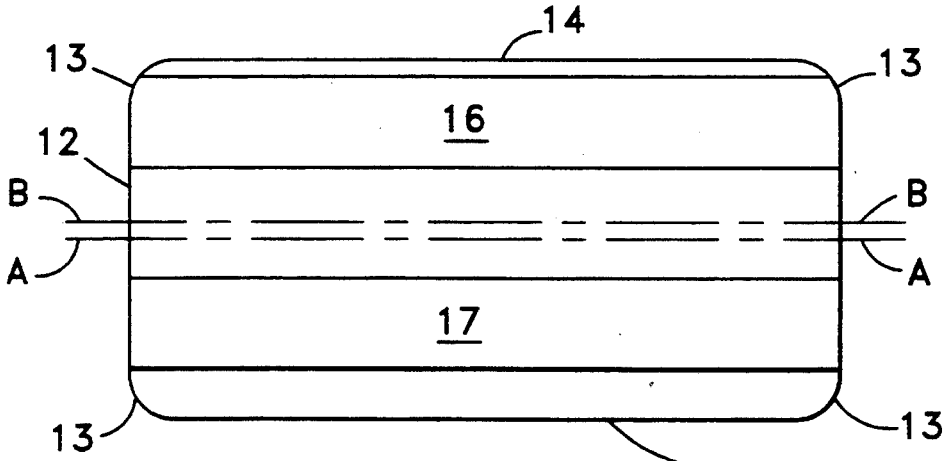
FIG. 3 is a front elevational view of the clamp, but showing the clamp as it appears when its two legs are folded away from each other to place the clamp in a flat, planar position.

Referring now to the drawing by numerals of reference, and first to FIGS. 1 to 3, 10 denotes a generally U-shaped paper clamp comprising an elongate strip 12 of rigid, plastic material, such as being made from a rigid vinyl. Strip 12, before being folded into a generally U-shaped configuration, or as it appears when positioned in an open, planar position as show in FIG. 3, is generally rectangular in configuration, and has rounded corners 13. Secured to one face of strip 12 between and parallel to its logitudinal side edges 14 and 15 are two, spaced, longitudinally extending magnetic strips 16 and 17 which are made from a conventional, flexible, magnetic material. In FIG. 3 the letter A denotes the longitudinal centerline of strip 12, or the centerline which is equally spaced from the longitudinal side edges 14 and 15 of the strip. It will be readily noted that the magnetic strip 17 is spaced further away from the adjacent side edge 15 of strip 12 then the strip 16 is spaced from edge 14 of strip 12. Likewise, strip 16 is spaced further away from the longitudinal centerline A of strip 12 than is the magnetic strip 17.

In accordance with one method of producing the clamp 10, the strips 16 and 17 are first secured to one surface of the strip 12 to extend parallel to each other between opposite ends of the strip 12 as shown in FIG. 3. In a manner described in greater detail hereinafter, strip 12 is then heated and folded about a radiused, longitudinally extending fold 21, the axis of which is denoted by the centerline B in FIG. 3. It will be noted that the axial centerline B of the fold 21 is parallel to but laterally offset or spaced slightly from the centerline A of strip 12, and is positioned midway between the confronting side edges of the magnetic strips 16 and 17. Moreover the strips 16 and 17 are equal in width, so that when strip 12 has been provided with the radiused fold 21, the two surfaces or sides of the strips 16 and 17 which are remote from the surfaces thereof that are fastened to the strip 12, will be held by the folded strip 12 in registering, confronting engagement with each as shown in FIG. 2. This is the normal, closed position of the clamp 10.

When clamp 10 is in its closed position, the two spaced, parallel leg sections 22 and 23 of the clamp (FIG. 2), which are connected together by the radiused fold section 21, are normally maintained in the positions of engagement as shown in FIG. 2. However, the radiused fold 21 provides a tension hinge that is flexible enough to permit the leg sections 22 and 23 to be pivoted manually away from each other whenever it is desired to insert paper documents between the then-separated magnetic strips 16 and 17. As soon as the leg sections 22 and 23 are released, the tensioned hinge or flexed fold 21 causes the leg sections to be urged back toward their closed positions as shown in FIG. 2, thus clamping the documents therebetween. This closing motion, of course, is supplemented by the magnetic field extending between the magnetic strips 16 and 17, so that there is, in fact, a dual clamping force applied to the documents that are positioned between the strips 16 and 17 - namely, the force created by the radiused fold 21 in strip 12, and the magnetic attraction created between strips 16 and 17.

Also as shown in FIG. 2, the leg section 22 of strip 12 is slightly longer than section 23, and therefore projects downwardly beyond its magnetic strip 17, and the lower edge 14 of leg section 23. The face of this portion of leg section 22 which projects downwardly beyond section 23 thus forms a display surface which is denoted at 25 in FIG. 1, and which may have information printed thereon.

Figure 4:
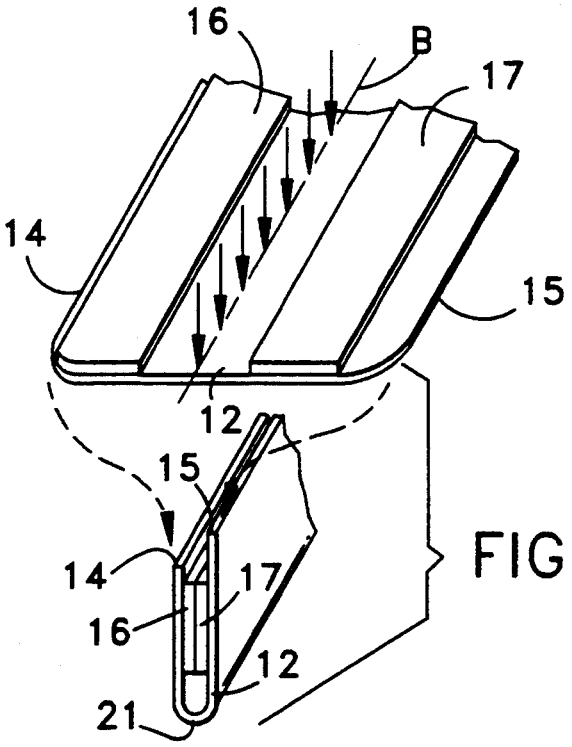
FIG. 4 is a fragmentary diagramatic perspective view showing one manner in which a radiused fold is adapted to be heat formed in the flexible, plastic strip of material which supports the magnetic strips of the clamp.

One preferred method of forming the strip 21 into its generally U-shaped configuration, after the magnetic strips 16 and 17 have been secured to its upper surface, is shown for example fragmentarily in FIG. 4. The strip 12, bearing the strips 16 and 17, is heated and conveyed beneath a so-called heat knife, which may be in the form of a stream of hot air directed downwardly and transversely against the upper surface of the heated strip 12 in a direction represented by the array of arrows shown on FIG. 4. This stream of hot air is centered generally medially of the space between the magnetic strips 16 and 17, and causes the heated strip 12 to be urged downwardly, for example as shown by the broken lines in FIG. 4, between spaced, stationary guides (not illustrated) which cause opposed, longitudinally extending portions of the strip 12 to be guided upwardly about the axis B until the two magnetic strips 16 and 17 are positioned into registering, confronting engagement with each other, at which time the radiused fold 21 will have been completed. The folded section 12 is then cooled while the faces of the strips 16 and 17 are engaged with each other, thus "setting" the fold 21 under tension so that it tends normally to remain in its closed position, as shown for example in FIG. 2, ad at the bottom of FIG. 4. The clamp 10 is then ready for use.

Figure 5:
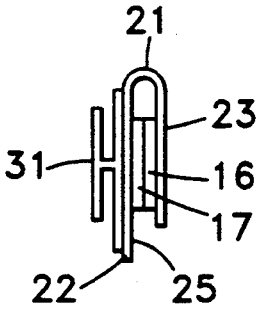
FIG. 5 is an end view similar to that of FIG. 2, but showing a modified form of the clamp having mounting means attached to one outside surface thereof.

It is often desirable to secure the clamp 10 to a plane surface, in which case a layer pressure sensitive adhesive can be applied to the outer face of the leg section 22, and then may be covered with a removable, plastic strip, which protects the pressure sensitive adhesive coating until such time that it is desired to secure the clip to a plane surface, or the like. Alternatively, as shown in FIG. 5 a conventional mounting bracket 31, which may be generally H-shaped in cross-sectional configuration, can be adhered or fixed permanently at one side to the outer surface of the leg section 22 of a clamp 10 so that the clamp may be mounted by the bracket 31 for sliding movement in the channel of a conventional, mating mounting bracket (not illustrated). Or if desired, a strip magnet may be secured to the outer surface of leg section 22 for mounting clamp 10 on a metal surface.

From the foregoing it will be apparent that the present invention provides a relatively simple and inexpensive magnetic paper clamp, which, unlike prior magnetic clamps, is normally urged by its radiused fold into a normally-closed position in which the associated magnetic strips of the clamp are normally maintained in registering engagement with each other. Thus the clamp is maintained in its closed position not only by virtue of the magnetic field which is created between the two magnetic strips, but also by virtue of the heat set fold or tension hinge 21, which tends to urge the two leg sections 22 and 23 of the clamp toward each other.

As a consequence, whenever the leg sections 22 and 23 are separated, thereby simultaneously separating the magnetic strips 16 and 17 one from the other, there is a tendency for the clamp to return immediately to its closed position. Moreover, by positioning the heat created radiused fold 21 in a laterally offset position relative to the longitudinal centerline of the strip 12, the projecting portion of the leg section 22 is provided with a display surface 25 which extends below the leg section 23 of the clamp, and which may have information printed thereon. During the folding operation it is important to maintain the heat knife in a plane which registers with the centerline of the space between the magnetic strips 16 and 17, so that the leg section 22 of the clamp 10 will extend the desired distance beyond leg section 23, and so that strips 16 and 17 will be in exact registry with each when clamp 10 is in its closed position.

In practice, it is preferred to provide the strip 12 with a matte finish, so that in addition to printing on the display surface 25, additional printing or design work may be printed or marked on the remaining, exterior surface of clamp 10.

Moreover, while the invention has been illustrated and described herein in detail in connection with only certain embodiments thereof, it will be apparent that it is capable of still modification, and that this application is intended to cover any such modifications as ay fall within the scope of one skilled in the art or the appended claims.

I claim:

1. A magnetic clamp for holding paper documents and the like, comprising a strip of generally rigid, heat-settable plastic material having a pair of opposed side edges, and a pair of opposed end edges extending transversely of said side edges, a pair of strip magnets each having opposed planar surfaces, and of said surfaces of each of said magnets being secured to and in contact with one surface of said plastic strip between said opposed side edges thereof, said magnets extending in spaced, parallel relation to each other between said opposed end edges of said plastic strip, said plastic strip being folded medially of the space between said magnets into generally U-shaped configuration about a radiused fold formed in said plastic strip to extend between said opposed end edges thereof coaxially of an axis which extends parallel to said strip magnets, thereby to place said strip magnets in registering engagement with each other, and said radiused fold being heat set into said plastic material, whereby the spaced, parallel leg sections of the U-shaped plastic strip are operative normally to urge the other of said planar surfaces of said strip magnets resiliently into coplanar engagement with each other in a plane containing said axis, thereby to supplement the force created by the magnetic field extending between said strip magnets.

2. A magnetic clamp as defined in claim 1, wherein said strip magnets are made from a flexible, magnetic material.

3. A magnetic clamp as defined in claim 1, wherein said strip magnets are substantially identical in configuration, said opposed side edges of said plastic strip extend parallel to each other and to said strip magnets, and the centerline of the space separating said magnets is offset laterally from, and extends parallel to, the centerline of said plastic strip between said side edges thereof.

4. A magnetic clamp as defined in claim 1, wherein the opposite surface of said plastic strip has thereon a matte finish.

5. A magnetic clamp as defined in claim 1, wherein one of said spaced, parallel leg sections of said U-shaped plastic strip is longer than the other leg section, and a portion of said one leg section of said plastic strip extends beyond said other section and said magnets.

6. A magnetic clamp as defined in claim 5, including means secured to the outer surface of one of said leg sections of said plastic strip and operable to support said clamp on a stationary surface.

7. A method of producing a magnetic clamp from a generally rectangularly shaped strip of heat-settable plastic material having a pair of opposed side edges, and a pair of opposed end edges extending transversely of said side edges, comprising securing one of two, opposed, planar surfaces of each of two strip magnets directly to one surface of said plastic strip to support said magnets on said plastic strip in spaced, parallel relation to each other, and with said magnets extending between said opposed end edges of said plastic strip, heating said plastic strip in the space between said strip magnets, folding said heated plastic strip into generally U-shaped configuration about a radiused fold extending between said opposed end edges of said plastic strip, and coaxially of an axis extending parallel to said magnets, and so that the other of said opposed planar surfaces of said magnets are placed in registering, coplanar engagement with each other in a plane containing said axis, and cooling said plastic strip while said other surfaces of said magnets are engaged with each other.

8. A method as defined in claim 7, wherein said heating of said plastic strip includes directing a stream of hot air against at east one side of said plastic strip to register medially of the space separating said strip magnets.

9. A method as defined in claim 7, including securing said strip magnets to said one surface of said plastic strip with the midpoint of the space between said magnets being spaced slightly further from one of said side edges of said plastic strip than the other side edge thereof.

10. A method as defined in claim 9, wherein said folding of said plastic strip includes guiding said strip in such manner that said radiused fold is located medially of said spaced magnets, whereby the resulting U-shaped plastic strip comprises two, spaced, parallel leg sections one of which is longer than the other.

* * * * *